US009345315B1

(12) United States Patent
Remmey

(10) Patent No.: US 9,345,315 B1
(45) Date of Patent: May 24, 2016

(54) BROOM SKIRT

(71) Applicant: WISHING YOU WELL PRODUCTS, INC., Greensboro, NC (US)

(72) Inventor: Theresa F. Remmey, Greensboro, NC (US)

(73) Assignee: Wishing You Well Products, Inc., Greensboro, NC (US)

( * ) Notice: Subject to any disclaimer, the term of this patent is extended or adjusted under 35 U.S.C. 154(b) by 585 days.

(21) Appl. No.: 13/753,905

(22) Filed: Jan. 30, 2013

(51) Int. Cl.

| | |
|---|---|
| ***A46B 17/08*** | (2006.01) |
| ***A47L 13/38*** | (2006.01) |
| ***A47L 13/44*** | (2006.01) |
| ***A46B 17/04*** | (2006.01) |

(52) U.S. Cl.
CPC ..... *A46B 17/04* (2013.01); *A46B 17/08* (2013.01); *A47L 13/38* (2013.01); *A47L 13/44* (2013.01)

(58) Field of Classification Search
CPC ..... A47L 13/12; A47L 13/44; A47L 13/38; A46B 2200/302; A46B 17/08
USPC ..... 15/247
See application file for complete search history.

(56) References Cited

U.S. PATENT DOCUMENTS

| | | | | |
|---|---|---|---|---|
| 1,360,926 | A | 11/1920 | Glenn | 15/247 |
| 1,617,764 | A * | 2/1927 | Lawrence | 15/114 |
| 2,320,372 | A * | 6/1943 | McCarthy | 15/229.7 |
| 2,963,731 | A | 12/1960 | Hoots | 15/274 |
| 3,956,155 | A | 5/1976 | Schwuger | 252/91 |
| 4,114,224 | A | 9/1978 | Disko | 15/229 |
| 4,961,242 | A | 10/1990 | Kresse et al. | 15/228 |
| 5,086,543 | A * | 2/1992 | Mitchell | 24/16 PB |
| 5,419,015 | A | 5/1995 | Garcia | 15/228 |
| 6,389,637 | B1 | 5/2002 | Hurell | 15/247 |
| 6,681,434 | B2 | 1/2004 | Smith | 15/104.93 |
| 6,701,567 | B2 | 3/2004 | Smith | 15/247 |
| 7,624,468 | B2 | 12/2009 | Reddy et al. | 15/104.94 |
| 2004/0031119 | A1 * | 2/2004 | McKay | A47L 13/18 15/227 |
| 2005/0000050 | A1 | 1/2005 | Galvin et al. | 15/226 |
| 2009/0320229 | A1 * | 12/2009 | Chen | 15/229.1 |

OTHER PUBLICATIONS

Wikipedia.org entry in Polar Fleece as of Dec. 26, 2012.

* cited by examiner

*Primary Examiner* — Michael Kornakov
*Assistant Examiner* — Natasha Campbell
(74) *Attorney, Agent, or Firm* — MacCord Mason PLLC

(57) ABSTRACT

An apparatus for application to a broom that includes a broom head provides enhanced cleaning. A skirt of polar fleece fabric has a yoke long enough so that one end of the polar fleece fabric laps the other end when wrapped around the broom head. Hook and loop fasteners on the yoke where one end laps the other end enable the skirt to remain wrapped around the broom head. A plurality of strips that are at least one to three inches longer than the height of the broom head and bristles depend from the yoke. The skirt of polar fleece fabric yoke and strips are conveniently made of a single piece of fabric. A fabric with a stretchable direction transverse to a non-stretchable direction works best if the yoke is substantially parallel to the non-stretchable direction.

13 Claims, 4 Drawing Sheets

BROOM SKIRT

BACKGROUND OF THE INVENTION

Brooms have been known for centuries as very useful cleaning tools. They provide relatively stiff and rigid bristles mounted in a head and, in most instances, a long handle is applied to the head. This allows a person to stand and manipulate the handle, thereby causing movement of the bristles over a floor or other (lower) or (upper) surfaces. The resilience of the bristles provides a springiness to the motion, allowing dirt and debris on a floor to be thrown by the springiness of the bristles or the movement of the broom altogether toward a gathering place where they can be picked up or simply swept out the door. Brooms work reasonably well for loose, large debris that has some heft and density, but do not work well for dust or other more light weight forms of dirt.

There have been efforts made to provide attachments to brooms to assist them in attacking different kinds of dirt, but none have been simple, effective, and low cost.

SUMMARY OF THE INVENTION

The present invention fulfills one or more of these needs in the art by providing an apparatus for application to a broom to provide enhanced cleaning with the broom that includes a broom handle and broom head that has bristles. A skirt of polar fleece fabric has a yoke long enough to surround the broom head, and a plurality of strips depending from the yoke, so they hang below the bristles of the broom head.

The skirt yoke may have two ends and be long enough so that one end of the yoke laps the other end when wrapped around the broom head, and hook and loop fasteners on the polar fleece fabric where the fabric of one end laps the other end enable the yoke to remain wrapped around the broom head. The skirt of polar fleece fabric may have a stretchable direction transverse to a non-stretchable direction; if so, the yoke that surrounds the broom head is preferably substantially parallel to the non-stretchable direction.

In one embodiment the strips extend at least three inches beyond the bristles of the broom. In other embodiments the strips extend at least one inch beyond the bristles of the broom. Typically, the strips are long enough so that selected strips can be passed between bristles of the broom and tied together above the broom head.

The skirt of polar fleece fabric may have additional layer, such as netting, sponge or foam.

In a variation, the yoke of the skirt of polar fleece fabric is long enough so that one end of the polar fleece fabric laps the other end when wrapped around the broom head, and elastic on the polar fleece fabric where the fabric of one end laps the other end enables the yoke to remain wrapped around the broom head.

Small bands, such as rubber bands can be added to tie strips positioned on opposite sides of the broom head together adjacent the bristle ends, so that when the broom having the skirt attached is rotated from normal so that the broom head is over the broom handle, the strips remain positioned above the broom head.

The invention can also be considered as a method of cleaning including applying a skirt of polar fleece fabric to a broom head having bristles by surrounding the broom head with a yoke of a skirt of polar fleece fabric so that a plurality of strips of polar fleece fabric depending from the yoke of the skirt hang downward from the affixed yoke to a position below the broom head and bristles. The skirted broom can then be used to clean using motions familiar to sweeping, Debris will adhere to the strips of polar fleece fabric. Cleaning preferably includes positioning the strips of polar fleece fabric where the debris is by directing bristles of the broom head to the debris and thereby contacting the debris with a strip that covers the directed bristles.

Cleaning can be done with strips that are substantially dry. Alternatively, cleaning can be done with strips that have been moistened.

Applying the skirt may include wrapping the yoke around the broom head, lapping ends of the wrapped yoke, and engaging hook and loop fasteners on the polar fleece fabric where the fabric of one end laps the other end to enable the skirt to remain wrapped around the broom head. If the skirt of polar fleece fabric has a stretchable direction transverse to a non-stretchable direction, then applying preferably includes orienting the fabric so that the non-stretchable direction is substantially transverse to the bristles.

Applying may include positioning the skirt so that the strips extend at least one to three inches below the bristles. Applying may include positioning the yoke so that selected strips can be passed between bristles of the broom head and tied together above the broom head.

The method may include tying strips from opposite sides of the broom head together with small bands, and raising the broom having the polar fleece fabric attached so that the broom head is over the broom handle, with the tied strips remaining positioned above the broom head.

Applying the skirt to a broom head may include passing a broom handle through a hole in the yoke, and bringing the yoke to the top of the broom head, so that the strips are deployed on either side of the broom bristles.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

As reported in Wikipedia, Polar fleece, usually referred to simply as "fleece," is a soft, napped, insulating synthetic fabric made from Polyethylene terephthalate (PET) or other synthetic fibers. The preferred fleece is 100% polyethylene terephthalate (colloquially known as polyester). One of the first forms was Polar Fleece created in 1979 by Malden Mills, now Polartec LLC., a new, light and strong pile fabric meant to mimic and in some ways surpass wool. Polar fleece has some of wool's finest qualities but weighs a fraction of the lightest available woolens.

Figure 1:
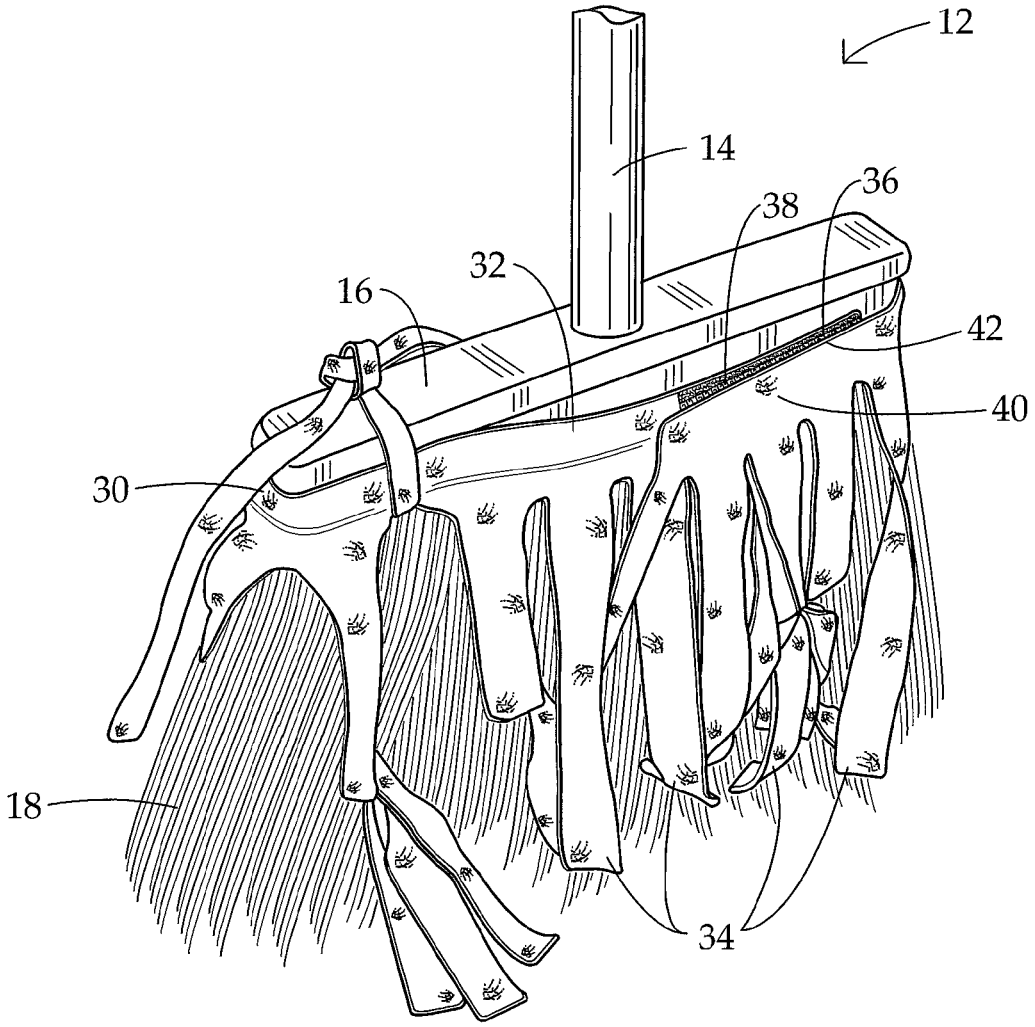
FIG. 1 is a perspective view of one side of a broom having an embodiment of the skirt applied to it.

While polar fleece is generally known as an apparel or blanket fabric, applicant has found that it makes a surprisingly good cleaning material, particularly when it is in a defined configuration and coupled with a broom. As seen in FIG. 1, a broom 12 has a typical handle 14 a head 16. A plurality of bristles 18 are mounted in the head 16 and deployed, typically fan shaped, out of the head 16. The top of the formed out bristles results in a narrowing or notch below the head. Other broom shapes are known in which the head is more of a binding of the upper portions of the bristles into a consolidated mat. While brooms with synthetic bristles are preferred, natural straw bristles can also be used. The head 16 provides a rigid base for the bristles 18, so that upon movement of the head 16 by manipulation of the handle 14, the bristles 18 can be positioned as desired by the user, with good precision. The bristles can be borne against the floor and pressure applied, causing the bristles to be deformed. When that pressure is released, the bristles spring back to their normal shape and cause debris nearby to be impacted and thrown in the direction of the springing motion of the bristles.

The skirt 30 is shown in FIG. 1 as mounted on the head 16. The skirt 30 includes a yoke 32 having a first end 36 and a second end 40. The two ends 36 and 40 are provided with complementary hook and loop fasteners 38 and 42. The yoke 32 can be wrapped around the head 16 or upper portion of the bristles 18, and the hook and loop fasteners can be engaged with one another to cause the yoke 32 to snuggly surround the head 16. Integral with the yoke 32 is a plurality of depending strips 34. The strips 34 are intentionally made considerably longer than the bristles 18, so that when the skirt 30 is applied to the broom, the lower portions of the strips 34 come into contact with the floor underneath the bristles 18. In so doing, the broom is modified by having a new surface of polar fleece strips 34, providing it with a different surface characteristic. Particularly, the polar fleece strips 34 have been found to be very good at attracting and holding small and large pieces of dirt, adhering to them better than the bristles 18 do alone. Thus, the broom 12 with the skirt 30 applied can be used to reach dirt by positioning the strips 34 under control of the bristles 18, so the strips 34 pick up dirt better than the bristles 18. A complementary interaction of the stiff resilient bristles 18 and the flexible, movable strips 34 provide a unique cleaning capability that neither can attain on its own. This combination is very effective at removing dirt from the nooks and crannies of baseboard moldings.

Figure 2:
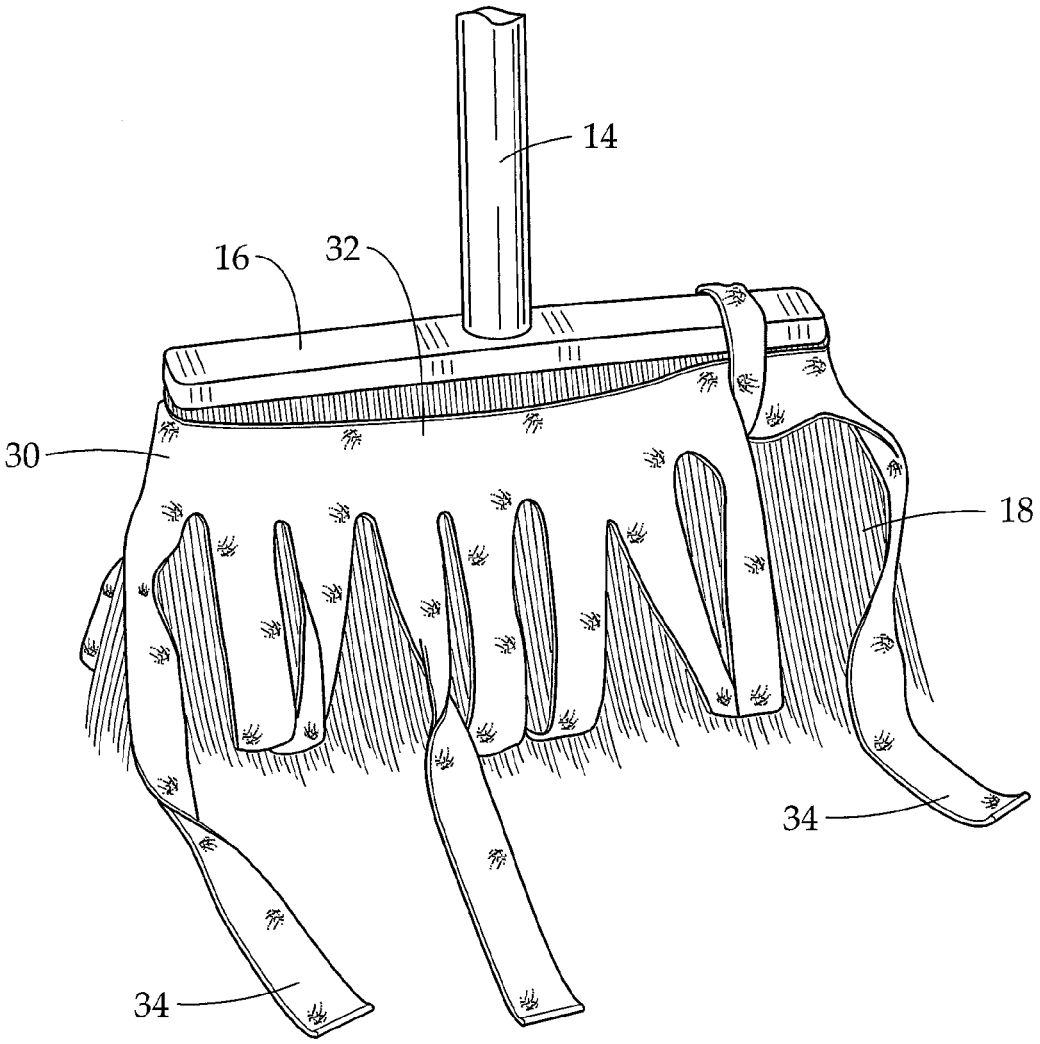
FIG. 2 is a perspective view from the other side of the broom and skirt of FIG. 1.

FIG. 2 shows the reverse side of the broom and skirt of FIG. 1, slightly modified. As seen, two of the strips can be threaded through the bristles and brought above the head 16 and tied as at 134 to provide additional securement of the skirt to the broom. In some embodiments such tying can be the way the skirt remains attached to the broom, dispensing with hook and loop or other fasteners around the head.

Figure 3:
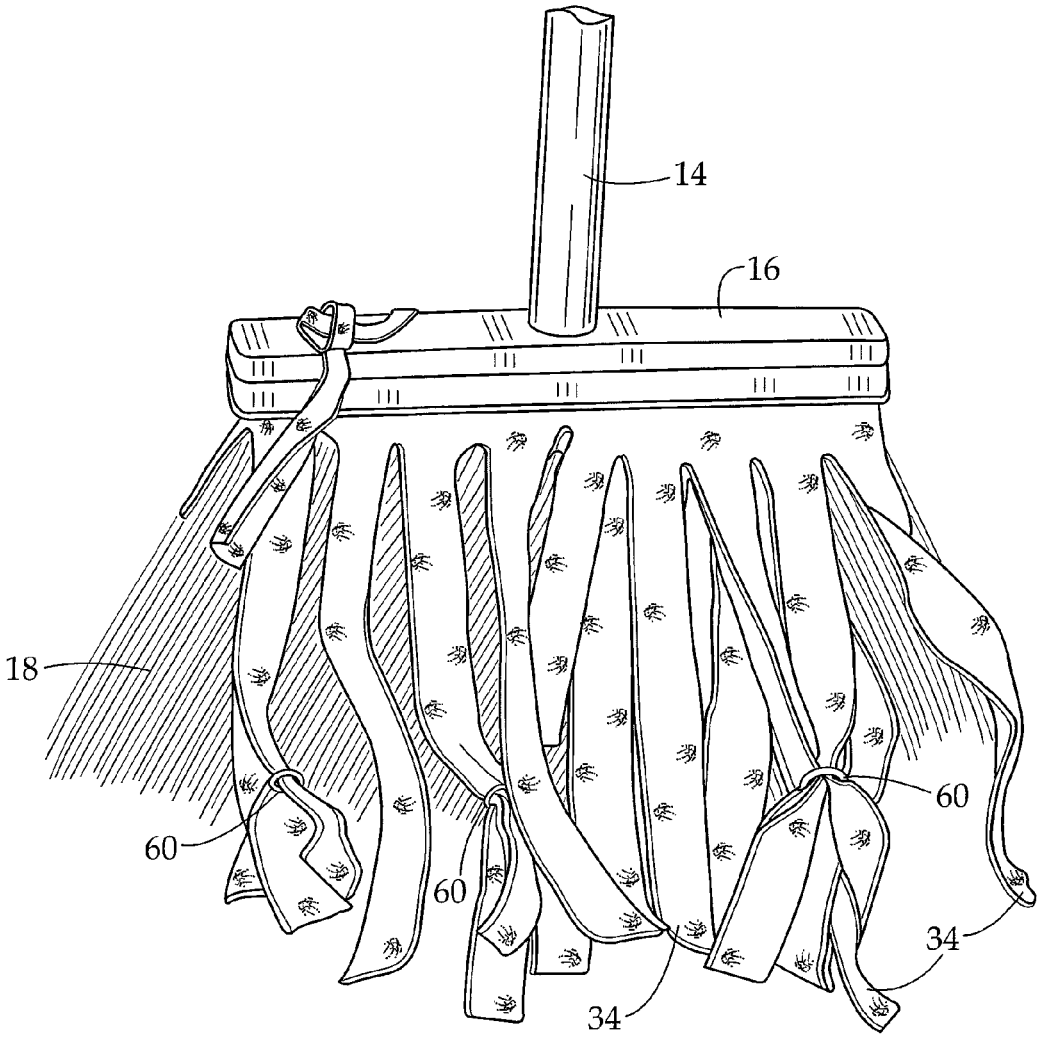
FIG. 3 is a perspective view of the broom and skirt of FIG. 1 with small bands applied.

FIG. 3 shows a further modification in which small rubber bands 60 are added. Several strips 34 from two opposing sides of the bristles can be threaded through the small rubber bands 60 and held together by the resilience of the rubber bands. By holding them in place at the end of the bristles 18, the strips are made to stay on the bottom end of the bristles. The thus-modified broom and skirt can then be used for cleaning overhead surfaces such as crown moldings and other high component, without having the strips fall back away from the bristles. This embodiment is also useful for cleaning tiles and grout lines in tiled walls such as shower walls. Other means for causing the strips from opposite sides of the bristles to be held together can also be used. For example, the strips may adhere to each other, such as with included hook and loop fasteners on the strips. Or the strips could be knotted with one another. The skirted broom is also useful for cleaning grout on tiled floors.

Polar fleece typically has a stretchy direction and a non-stretchy direction that is transverse to the stretchy direction. Preferably the non-stretchy direction is parallel with the yoke, so that when fitting the yoke around the head the hook and loop fasteners can be snuggly positioned without additional regard for possible stretching. The stretchiness of the fabric in the strips is therefore substantially parallel with the length of the strips. The skirt can be made in lengths to go around the broom head more than once, providing additional cleaning strips. Indeed, since the perimeter length of the broom head can vary from broom to broom, a commercial embodiment is preferably made long enough to at least once encircle the largest broom head expected; when it is applied to a smaller broom head, there will be additional fabric to extend the wrap more than once around the head. To accommodate the resulting unpredictable number of wraps, the hook and loop or other fasteners can be sized and/or located to be able to fasten under any reasonably-expected number of wraps (or partial wraps). The yoke need not be applied to the head in all cases. The yoke could be wrapped around the top of the bristles, which form a narrowing or notch below the broom head, particularly when the head takes the form of a plastic or metal housing in which the bristles are anchored.

The entire skirt can be conveniently be made of a single piece of polar fleece fabric by simply cutting a rectangle having a length long enough to go around the head of the broom and fasten to itself and a width longer than the length of the bristles. In particular, it is desired that the width be great enough so that the strips extend at least one inch below the bristles. More preferred is for the strips to extend at least three inches below the bristles. The strips can be made to be even longer, and if the user finds them to be too long, the excess can be simply cut down to a desired size. The skirts can be made in various sizes to cooperate with various sizes of brooms.

The strips are formed in the rectangle by making a plurality of parallel cuts that extend from one side toward, but not all way to, the other side. The cuts need not be equally spaced; the result of unequal spacings being varying strip width, which is within the scope of the invention. The remaining, uncut portion forms the yoke of the skirt. Hook and loop fasteners can then be applied to the yoke of the skirt by sewing or other convenient means. Other fasteners such as a button/buttonhole, snaps, safety pins and the like can be substituted for the hook and loop fasteners. (In a less preferred form, polar fleece strips can be attached to a separate yoke component, such as by sewing or the like, with the yoke in that case not necessarily being polar fleece.)

In another embodiment, hook and loop fasteners can be used to removably mount the skirt to the broom. Either the hook or loop type fastener component may be mounted to the broom head by an adhesive, with the other type of fastener attached to the yoke of the skirt, allowing removable attachment of the skirt to the yoke.

It is also within the scope of the invention if the skirt includes some strips that are not as long as others and therefore do not extend below the bottoms of the bristles.

Figure 4:
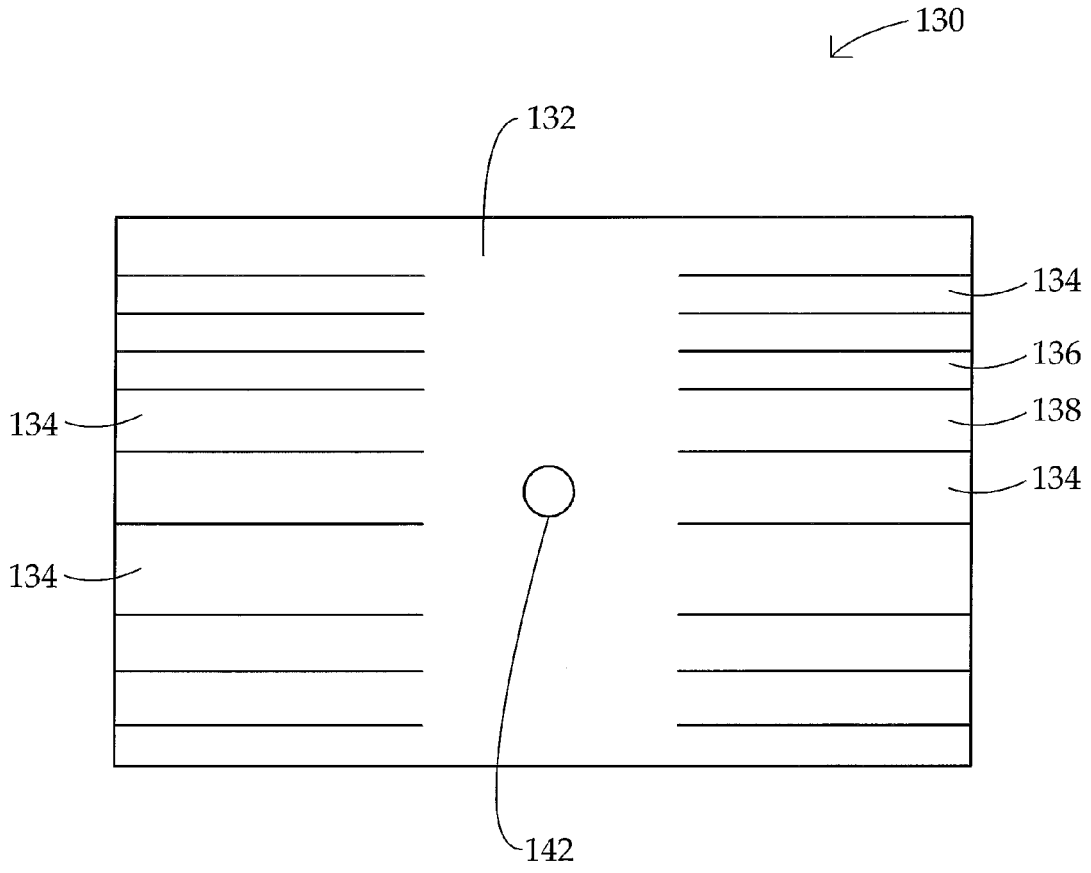
FIG. 4 is a plan view of another embodiment of the skirt, without the broom.

FIG. 4 shows another embodiment of the skirt 130, not yet mounted on a broom. Skirt 130 has a yoke 132, a plurality of strips 134 on either side, and a hole 142 at about the midpoint of the yoke. This embodiment can be made by starting with a rectangular piece of polar fleece, cutting into its opposed ends to form the strips, and cutting the hole 142. In use, the broom handle is slipped through the hole 142, the yoke 132 is brought to the top of the broom head, and the strips 134 are deployed on either side of the broom bristles. Selected ones of the strips can be passed through the bristles and tied over the top of the broom head, using the technique described above to secure the skirt 130 to the broom. FIG. 4 also shows that strips 136 and 138 can vary in width from others of the strips. This embodiment cleans well, also. To remove it from the broom, the strips are untied from above the head and the skirt is pulled up, withdrawing the broom handle from hole 142. If desired, other modes of securing the skirt 130 to the broom head can be used, such as tying around the side of the broom head.

In either embodiment, the resulting skirt is a low cost, light-weight, surprisingly effective addition to a broom. The strips work into nooks and crannies of areas to be cleaned by being directed by the bristles, providing better cleaning. The skirt can be used repeatedly. When it becomes excessively soiled, the skirt can be removed from the broom and laundered for reuse. The combination of skirt and broom is particularly effective on hardwood and other non carpeted floors.

While the skirt works well in dry form, it can also be used moist. The polyester of the fabric does not instantaneously absorb as much water as cotton, so the broom with attached skirt can be dipped into a bucket of water to release soil from the skirt into the water with less uptake of water into the skirt than a cotton fabric would likely hold onto. The fabric can become either moist or wet, depending on how long the broom skirt is left in the water, and the moist or wet fabric can also be effective in picking up dirt and grime. The addition of the fleece to the broom extends the work time of the broom because it holds onto more dirt than the broom by itself because the bristles keep the cloth and dirt together. It is also believed to be extend the work time over a comparable mop, since the bristles help the fleece reach and "scour" adhering dirt. A broom alone cannot hold onto as much water or cleaner, nor can it pick up as much dirt as a cloth. Because the skirt is a lightweight polyester fabric, it requires less wringing than a regular mop head.

Additionally layers can be formed onto the skirt. In particularly, sponge and netting can be adhered by an adhesive, sewing or other means and provide a physical reinforcement for the polar fleece. This modification allows use in heavy duty situations such as cleaning outdoor concrete patios, stone decking, and similar coarser and/or abrasive surfaces.

The way the polyester fabric absorbs water, swells and releases the attached dirt when put into a bucket of water allows for a preferable cleaning tool than a traditional cotton mop that doesn't let go of dirt as well, or a sponge mop that doesn't pick up as much dirt. The polyester fabric does get wet, but polyester releases the water more rapidly than cotton when pulled out of bucket, so less wringing is needed. It can also be washed and sanitized, unlike a typical mop. Hospitals can use this product to retard the spread of germs.

In another mode of use, the floor can be sprayed with a diluted cleaner or water, and then worked with the skirted broom in the fashion of a conventional dry mop. This works really well, kind of like cleaning with a rag on hands and knees, and really fast too.

The combination of a dry or damp cloth with the action and force of broom bristles allows a wet and chunky spill or accident to be cleaned up easily.

In another mode of use, only the bottom part of cloth below the bristle line is wetted. That wetted cloth is used to clean. Then, the skirted broom is extended so more of the surface area of cloth (upper portions of strips and the yoke) touches floor, resulting in cleaning like using an extra cloth.

In another mode of use, the broom can be equipped with two of the skirts, which enhances the work power. The skirt can be made from a longer piece of fabric, such as a 40 inch wrap instead of a 30 inch, so the skirt can wrap the broom more than once.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus to provide enhanced cleaning comprising a broom that includes a broom handle and broom head with bristles, and a skirt having a yoke long enough to surround the broom head, and a plurality of strips of polar fleece fabric depending from the yoke longer than the height of the broom head, so they hang below the bristles.

2. An apparatus as claimed in claim 1 wherein the yoke is polar fleece fabric and has two ends and that is long enough so that one end of the yoke laps the other end when wrapped around the broom head, and hook and loop fasteners on the polar fleece fabric where the fabric of one end laps the other end enable the yoke to remain wrapped around the broom head.

3. An apparatus as claimed in claim 1 wherein the skirt is made of a sheet of polar fleece fabric and has a stretchable direction transverse to a non-stretchable direction and the yoke that surrounds a broom head is substantially parallel to the non-stretchable direction.

4. An apparatus as claimed in claim 1 wherein the strips extend at least one inch below bristles of the broom head.

5. An apparatus as claimed in claim 1 wherein the strips are long enough so that selected strips can be passed between bristles of the broom head and tied together above the broom head.

6. An apparatus as claimed in claim 1 wherein the skirt of polar fleece fabric has additional layers.

7. An apparatus as claimed in claim 6 wherein the additional layer is netting.

8. An apparatus as claimed in claim 1 the skirt has a yoke long enough so that one end laps the other end when wrapped around the broom head, and elastic on the yoke where the fabric of one end laps the other end enables the yoke to remain wrapped around the broom head.

9. An apparatus as claimed in claim 1 wherein the skirt has means for causing the strips from opposite sides of the bristles to be held together to tie strips positioned on opposite sides of the broom head together adjacent the bristle ends, so that when the broom having the skirt attached is raised so that the broom head is over the broom handle, the strips remain positioned above the broom head.

10. An apparatus as claimed in claim 9 wherein the means for causing the strips from opposite sides of the bristles to be held together are small bands.

11. An apparatus to provide enhanced cleaning comprising a broom that includes a broom head, and a skirt of polar fleece fabric having a yoke long enough so that one end of the polar fleece fabric laps the other end when wrapped around the broom head, and hook and loop fasteners on the polar fleece fabric where the fabric of one end laps the other end enable the skirt to remain wrapped around the broom head, and a plurality of strips that are long enough so that they extend at least one inch longer than the bristles when the yoke is wrapped around the broom head, the skirt of polar fleece fabric yoke and strips being of a single piece of fabric and having a stretchable direction transverse to a non-stretchable direction and the yoke that surrounds a broom head is substantially parallel to the non-stretchable direction.

12. A cleaning apparatus comprising a broom that includes a broom handle and broom head with bristles, and a skirt having a yoke surrounding the broom head and a plurality of strips of polar fleece fabric depending from the yoke longer than the height of the broom head, so they hang below the bristles.

13. An apparatus as claimed in claim 6 wherein the additional layer is sponge or foam.

* * * * *